US009048016B2

(12) United States Patent
Hu et al.

(10) Patent No.: US 9,048,016 B2
(45) Date of Patent: Jun. 2, 2015

(54) COMPOSITE PERMANENT MAGNETIC MATERIAL AND PREPARATION METHOD THEREOF

(75) Inventors: Yongjun Hu, Dongguan (CN); Jiahong Meng, Dongguan (CN); Yunxiu Hu, Dongguan (CN)

(73) Assignee: DONGGUAN XUANYAO ELECTRONICS CO., LTD., Dongguan, Guangdong Province (CN)

( * ) Notice: Subject to any disclaimer, the term of this patent is extended or adjusted under 35 U.S.C. 154(b) by 0 days.

(21) Appl. No.: 13/549,421

(22) Filed: Jul. 14, 2012

(65) Prior Publication Data

US 2013/0076469 A1 Mar. 28, 2013

(30) Foreign Application Priority Data

Sep. 26, 2011 (CN) ..... 2011 1 0289248

(51) Int. Cl.

| | |
|---|---|
| ***H01F 1/08*** | (2006.01) |
| ***H01F 1/10*** | (2006.01) |
| ***H01F 1/113*** | (2006.01) |
| ***H01F 1/057*** | (2006.01) |
| *H01F 1/055* | (2006.01) |

(52) U.S. Cl.

CPC ..... *H01F 1/083* (2013.01); *Y10T 156/10* (2015.01); *H01F 1/0557* (2013.01); *H01F 1/0558* (2013.01); *H01F 1/0577* (2013.01); *H01F 1/0578* (2013.01); *H01F 1/10* (2013.01); *H01F 1/113* (2013.01)

(58) Field of Classification Search

CPC ..... G01R 33/383
USPC ..... 335/296, 302
See application file for complete search history.

(56) References Cited

U.S. PATENT DOCUMENTS

| | | | | |
|---|---|---|---|---|
| 3,424,578 | A * | 1/1969 | Hoffer et al. | 419/33 |
| 4,418,420 | A * | 11/1983 | Bauer et al. | 378/187 |
| 5,485,045 | A * | 1/1996 | Canders et al. | 310/156.31 |
| 6,104,271 | A * | 8/2000 | Barrett | 335/306 |
| 6,348,275 | B1 * | 2/2002 | DeCristofaro et al. | 428/800 |
| 6,828,026 | B2 * | 12/2004 | Bretschneider et al. | 428/404 |
| 7,336,858 | B1 * | 2/2008 | Moore et al. | 385/11 |
| 8,207,806 | B2 * | 6/2012 | Kudo et al. | 335/296 |
| 8,481,179 | B2 * | 7/2013 | Mori et al. | 428/693.1 |
| 2008/0113358 | A1 * | 5/2008 | Kapur et al. | 435/6 |
| 2009/0067232 | A1 * | 3/2009 | Korenivski | 365/171 |
| 2011/0241469 | A1 * | 10/2011 | Kjeldsteen et al. | 310/156.38 |
| 2012/0280760 | A1 * | 11/2012 | Cruickshank et al. | 333/1.1 |

FOREIGN PATENT DOCUMENTS

| | | | |
|---|---|---|---|
| CN | 2620359 | Y | 6/2004 |
| CN | 101552078 | A | 10/2009 |
| EP | 2381452 | A1 * | 10/2011 |
| JP | S1986136204 | U | 8/1986 |

* cited by examiner

*Primary Examiner* — Mohamad Musleh
(74) *Attorney, Agent, or Firm* — Kilpatrick Townsend & Stockton LLP

(57) ABSTRACT

The invention relates to the field of permanent magnet materials, and discloses a composite permanent magnet material. The material is formed by splicing at least one permanent magnet material, with binding agent in between. The novel composite permanent magnet material that is formed by splicing different magnets greatly enriches the existing permanent magnet system and can completely replace the expensive rare metallic magnetic material. The composite permanent magnet material disclosed by the invention has high performances. The magnetic performance of the magnet can be regulated and controlled by adjusting the type and length of the magnets. In particular, the magnetic blank between the bonded NdFeB and the sintered NdFeB provides the designer and user of permanent magnetic motors with broader and flexible in material selection space and cost selection space.

1 Claim, No Drawings

COMPOSITE PERMANENT MAGNETIC MATERIAL AND PREPARATION METHOD THEREOF

FIELD OF THE INVENTION

The invention relates to the field of permanent magnetic materials, particularly a permanent magnet for motors.

BACKGROUND OF THE INVENTION

The permanent magnetic material is a fundamental functional material in electronic industry. As an important component of magnetic materials, the permanent magnetic material plays an important role in electronic industry, information industry, motorcycles, electronic tools and auto industry, etc. The permanent magnetic material is a functional material that generates the magnetic field. The permanent magnetic material for a traditional DC motor, no matter a sintered product or a plastic magnetic product, adopts a uniform material. After the dimension of the motor has been determined, the geometric dimension of the permanent material is determined. Therefore, the magnetic property of the permanent magnetic material can only be adjusted by changing the material (type of material and grade of the material), such as sintered NdFeB N 3 5 S H , N42SH; ferrite; bonded NdFeB BNM-10 (corresponding to MQ magnetic powder B), BNM-8SR (corresponding to MQ magnetic powder 14-12), AlNiCo or SmCo, etc. However, different types of permanent magnetic materials vary greatly in this property, including the maximum magnetic energy product (BH) max, residual magnetism Br, coercivity Hcj, magnetic induction coercivity Hcb, etc. For example, the most frequently used ferrite, bonded NdFeB and sintered NdFeB mainly represent this property, as shown in the table below:

TABLE 1 main properties of Commercial Magnets

| | Magnetic property | | |
|---|---|---|---|
| Magnets | Residual magnetism Br (T) | CoercivityHcj (kA/m) | Maximum magnetic energy product (BH)max kJ/m3 |
| Ferrite | 0.3-0.44 | 250-350 | 25-36 |
| Bonded NdFeB | 0.6-0.78 | 500-1300 | 28-96 |
| Sintered NdFeB | 1.1-1.4 | 800-2400 | 240-420 |

From Table 1 can we see that bonded NdFeB can basically be butt jointed with ferrite in a magnetic energy product. However, there is a big property blank between sintered NdFeB and bonded NdFeB. Therefore, these materials restrict magnetic circuit design and actual application greatly.

At present, the most frequently used is ferrite permanent magnet. Although the magnetic property is comparatively low, the low price decides the absolute share in conventional fields. With technological progress and rising requirements on light, thin, short and small automatic appliances and articles, demand of rare earth magnet with high magnetic energy product is raised increasingly. However, rare earth magnet with high magnetic energy product is expensive, which restricts development of many motors or permanent magnets. Therefore, a magnetic material with both low price and high magnetic energy product is needed.

SUMMARY OF THE INVENTION

In order to solve the problem above, the embodiment of the invention provides

The invention is realized as follows:

A composite permanent magnet material, wherein the composite permanent magnet material is formed by splicing at least one permanent magnet material, with binding agent in between.

Optionally, the sliced permanent magnets are of the same material and different magnetic properties.

Optionally, the sliced permanent magnets are of different materials.

The sliced permanent magnet includes but is not limited to one or a plurality of isotropic sintered ferrite, anisotropic sintered ferrite, isotropic bonded ferrite, anisotropic bonded ferrite, AlNiCo, sintered NdFeB, isotropic bonded NdFeB, anisotropic bonded NdFeB, sintered SmCo, bonded SmCo, SmFeN, and bonded magnets that are made through pressing, injection and extrusion, etc. In the invention, all permanent magnets are included.

Optionally, the binding agent is polyurethanes binding agent or two-component modified acrylic ester curing agent or epoxy binding agent or anaerobic binding agent.

The invention also provides a preparation method of the composite permanent magnetic material, characterized in that at least one permanent magnet is arranged as per requirements of the target magnet and spliced with adoption of the binding agent. The permanent magnets are spaced according to odd numbers or even numbers.

Spacing according to odd numbers, namely total amount of two magnets is M=2*N+1 (N≥1). Two magnets of different materials are spaced into an integrated magnet. If N=2, the layout is strong magnet+weak magnet+strong magnet+weak magnet+strong magnet, or weak magnet+strong magnet+weak magnet+strong magnet+weak magnet; N=3, the layout is weak magnet+strong magnet+weak magnet+strong magnet+weak magnet+strong magnet+weak magnet, or strong magnet+weak magnet+strong magnet+weak magnet+strong magnet+weak magnet+strong magnet, and so on. Meanwhile, length of the strong magnet and weak magnet can be adjusted as per requirements of integrated magnet.

Spacing according to even numbers means: total amount of two magnets is M=2*N (N≥1). Magnets of the same material are arranged in one group while magnets of different materials are spaced. If N=2, strong magnet+strong magnet+weak magnet+weak magnet+strong magnet+strong magnet+weak magnet+weak magnet, or weak magnet+weak magnet+strong magnet+strong magnet+weak magnet+weak magnet+strong magnet+strong magnet, and so on. Meanwhile, length of the strong magnet and weak magnet can be adjusted as per requirements of integrated magnet.

Optionally, the anaerobic adhesive is adopted for the binding agent. The permanent magnets are activated before binding (1) performing electrophoresis for all permanent magnets;

(2) soaking permanent magnets that have undergone electrophoresis in anaerobic adhesive accelerator for surface activation;

(3) coating anaerobic adhesive to permanent magnets where necessary, checking the position, then having permanent magnets bonded, and then curing.

The novel composite permanent magnet material that is formed by splicing different magnets greatly enriches the current permanent magnet system and can completely replace expensive rare metallic magnetic material. The novel composite permanent magnet material provided by the invention has high performances, solving the problem that the development of magnets and motors is restrained by shortage of resources, and lowering cost of magnets. The magnetic property of the magnet can be regulated and controlled by adjusting type and length of the magnets. In particular, the magnetic blank between the bonded NdFeB and the sintered NdFeB privides the designer and the users of permanent magnetic motors with broader room and flexibility in material selection space and cost selection space. For example: after being magnetized, the composite magnet in the layout of weak magnet+strong magnet+weak magnet can be strong in the middle and weak on both sides. This property can be adjusted by changing the difference between the middle strong magnet and weak magnets on both sides.

DETAILED DESCRIPTION OF THE PREFERRED EMBODIMENTS

The composite permanent magnet material in the embodiment of the invention is formed through splicing permanent magnets of different magnetic properties. The anaerobic adhesive is adopted between magnets (such as Loctite cylindrical retaining compound-6 series and Loctite structural binding glue-3 series) as binding agent). The permanent magnets are activated before binding:

(1) Performing electrophoresis for all permanent magnets;

(2) Soaking permanent magnets that have undergone electrophoresis in anaerobic adhesive accelerator (such as Loctite 7649) for surface activation;

(3) coating anaerobic adhesive uniformly to permanent magnets where necessary, checking the position, then having permanent magnets bonded, 10 min later, removing residual glue at the bonded part using the rag with acetone on it, and then curing for 10 min under 120° C. an hour later.

Representation of permanent magnet for motors: The central magnetic field is an important parameter. The main parameter to be tested after different magnets have been spliced is the central magnetic field after the product has been magnetized and placed into the shell.

The weak magnet in the embodiment is bonded NdFeB (such as BNM-10) and strong magnet is sintered NdFeB (such as N35SH). The magnetic property can be changed from bonded NdFeB (such as BNM-10) to sintered NdFeB (such as N35SH).

Embodiment 1:

With regard to the magnetic product with outer diameter of 19.8 mm, inner diameter of 16.8 mm, camber surface of 135°, wall thickness of 3.5 mm, width of 35 mm and height of 19.5 mm:

Products that only adopt bonded NdFeB BNM-10 (corresponding to MQ magnetic powder B) adopt radial magnetization. Polar N and Polar S are arranged in the motor shell, forming a circular magnet with the inner radius of 16.8. The measured central magnetic field is 650-670 Gs;

Products that only adopt bonded NdFeB BNM-12 (corresponding to MQB+magnetic powder) adopt radial magnetization. Polar N and Polar S are arranged in the motor shell, forming a circular magnet with the inner radius of 16.8. The measured central magnetic field is 750-770 Gs;

Products that only adopt sintered NdFeB N35SH adopt parallel magnetization. Polar N and Polar S are arranged in the motor shell, forming a circular magnet with the inner radius of 16.8. The measured central magnetic field is 950-980 Gs;

The composite magnetic material that is formed through splicing bonded NdFeB BNM-10 of 7.7 mm high+sintered NdFeB N38S of 4 mm high+bonded NdFeB BNM-10 of 7.7 mm high adopts radial magnetization. Polar N and Polar S are arranged in the motor shell, forming a circular magnet with the inner radius of 16.8. The measured central magnetic field is 750-770 Gs;

The composite magnetic material that is formed through splicing bonded NdFeB BNM-12 of 7.7 mm high+sintered NdFeB N38S of 4 mm high+bonded NdFeB BNM-12 of 7.7 mm high adopts radial magnetization. Polar N and Polar S are arranged in the motor shell, forming a circular magnet with the inner radius of 16.8. The measured central magnetic field is 810-830 Gs;

The composite magnetic material that is formed through splicing bonded NdFeB BNM-10 of 6.7 mm high+sintered NdFeB N38S of 6 mm high+bonded NdFeB BNM-10 of 6.7 mm high adopts radial magnetization. Polar N and Polar S are arranged in the motor shell, forming a circular magnet with the inner radius of 16.8. The measured central magnetic field is 850-870 Gs;

The composite magnetic material that is formed through splicing bonded NdFeB BNM-12 of 6.7 mm high+sintered NdFeB N38S of 6 mm high+bonded NdFeB BNM-12 of 6.7 mm high adopts radial magnetization. Polar N and Polar S are arranged in the motor shell, forming a circular magnet with the inner radius of 16.8. The measured central magnetic field is 920-950 Gs.

Different bonded NdFeB magnets and sintered NdFeB magnets are spliced. The central magnetic field may implement transition from properties of bonded NdFeB to properties of sintered NdFeB, providing the designer and the users of permanent magnetic motors with broader room and flexibility in material selection and cost selection.

Embodiment 2:

With regard to the magnetic product with outer diameter of 16.9 mm, inner diameter of 12.9 mm, camber surface of 135°, wall thickness of 4.05 mm, width of 30 mm and height of 32 mm:

The product that only adopts bonded NdFeB BNM-10 of 32 mm high adopts radial magnetization. Polar N and Polar S are arranged in the motor shell, forming a circular magnet with the inner radius of 12.9. The measured central magnetic field is 1160-1170 Gs;

The 32 mm high composite permanent magnetic material that is made of two bonded NdFeB BNM-10 magnets through splicing adopts radial magnetization. Polar N and Polar S are arranged in the motor shell, forming a circular magnet with the inner radius of 12.9. The measured central magnetic field is 1210-1230 Gs;

The product that only adopts bonded NdFeB BNM-12 of 32 mm high adopts radial magnetization. Polar N and Polar S are arranged in the motor shell, forming a circular magnet with the inner radius of 12.9. The measured central magnetic field is 1230-1240 Gs;

The 32 mm high composite permanent magnetic material that is made of two bonded NdFeB BNM-12 magnets of 16 mm high through splicing adopts radial magnetization. Polar N and Polar S are arranged in the motor shell, forming a circular magnet with the inner radius of 12.9. The measured central magnetic field is 1290-1300 Gs;

The composite permanent magnetic material that is formed through splicing bonded NdFeB BNM-12 of 11 mm high+sintered NdFeB N38S of 10 mm high+bonded NdFeB BNM-12 of 11 mm high adopts radial magnetization. Polar N and Polar S are arranged in the motor shell, forming a circular magnet with the inner radius of 12.9. The measured central magnetic field is 1590-1610 Gs;

The composite permanent magnetic material that is formed through splicing bonded NdFeB BNM-12 of 10 mm high+sintered NdFeB N38S of 12 mm high+bonded NdFeB BNM-12 of 10 mm high adopts radial magnetization. Polar N and Polar S are arranged in the motor shell, forming a circular magnet with the inner radius of 12.9. The measured central magnetic field is 1660-1680 Gs.

The magnet that adopts a single 32 mm high bonded NdFeB magnet, such as W-type magnet in this case, vertical molding is adopted. Due to dual-way compression, the product has high density at both ends and low density in the middle. The product is high while the total density is not high. With regard to the 32 mm high composite permanent magnetic material that is formed through splicing two H=16 mm bonded NdFeB magnets, the density of each 16 mm magnets is improved accordingly. After splicing, the density in the middle is the highest (the magnetic force is strong). The products made through splicing are 4-5% higher than the one-time molded product in weight because this property of products of the nature of the bonded NdFeB has positive correlation with weight basically. After magnetization, the central magnetic field is 4-5% higher.

The composite permanent magnets of type 5 and type 6 in embodiment 2 have central magnetic field 28.5% higher than that of the composite permanent magnets that are formed through splicing two bonded NdFeB BNM-12 magnets, and 35% higher than that of products that are only made of bonded NdFeB BNM-12.

Technical solutions for the embodiment of the invention above are specified. In this text, cases are adopted to specify the principles and methods of implementation of the embodiment of the invention. Specifications of the embodiment above are only for understanding the principle of the embodiment of the invention; and meanwhile, the general technicians in this field can make changes in both method of implementation and scope of application based on the embodiment of the invention. To sum up, contents of the specification should not be construed as limitation to the invention.

What is claimed is:

1. A composite permanent magnetic material, characterized in that, the composite permanent magnetic material is made by splicing at least two permanent magnets, with a binding agent in between, wherein the permanent magnets are one or more of: sintered NdFeB, isotropic bonded NdFeB, and anisotropic bonded NdFeB;

wherein the binding agent is a polyurethanes binding agent or a two-component modified acrylic ester curing agent or an epoxy binding agent or an anaerobic binding agent;

wherein the composite permanent magnetic material is made by arranging the permanent magnets as per requirements of the target magnet and splicing with the binding agent;

wherein the permanent magnets are spaced according to odd numbers or even numbers;

wherein according to odd numbers, the total amount of two magnets is $M=2*N+1$ ($N\geq1$) and two magnets of different materials are spaced into an integrated magnet; and wherein according to even numbers, the total amount of two magnets is $M=2*N$ ($N\geq1$) and magnets of the same material are arranged in one group while magnets of different materials are spaced.

* * * * *